US009739517B2

(12) United States Patent
Root

(10) Patent No.: US 9,739,517 B2
(45) Date of Patent: Aug. 22, 2017

(54) CONTROLLING THE OPERATION OF A DISPENSER SYSTEM

(71) Applicant: General Electric Company, Schenectady, NY (US)

(72) Inventor: Steven Keith Root, Buckner, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 52 days.

(21) Appl. No.: 14/831,989

(22) Filed: Aug. 21, 2015

(65) Prior Publication Data

US 2017/0051963 A1 Feb. 23, 2017

(51) Int. Cl.

| | |
|---|---|
| ***F25C 5/00*** | (2006.01) |
| ***B67D 1/08*** | (2006.01) |
| ***F25D 23/12*** | (2006.01) |

(52) U.S. Cl.

CPC ..... *F25C 5/005* (2013.01); *B67D 1/0888* (2013.01); *F25D 23/126* (2013.01); *F25C 2700/02* (2013.01); *F25C 2700/04* (2013.01)

(58) Field of Classification Search

CPC .... F25C 5/00; F25C 2400/10; F25C 2700/02; F25C 2700/04; B67D 1/0888; F25D 23/028

USPC ..... 141/94, 95, 192, 198; 62/389; 222/146.6

See application file for complete search history.

(56) References Cited

U.S. PATENT DOCUMENTS

| | | | | |
|---|---|---|---|---|
| 4,944,335 | A * | 7/1990 | Stembridge | B06B 1/0681 141/1 |
| 6,698,291 | B2 | 3/2004 | Yamamoto | |
| 6,701,395 | B1 | 3/2004 | Byrne et al. | |
| 7,028,725 | B2 * | 4/2006 | Hooker | F25C 5/005 141/141 |
| 7,743,801 | B2 * | 6/2010 | Janardhanam | F25D 23/126 141/351 |
| 8,109,301 | B1 * | 2/2012 | Denise | F25C 5/005 141/198 |
| 8,353,321 | B2 * | 1/2013 | Agam | B67D 1/124 141/198 |
| 8,456,478 | B2 * | 6/2013 | Samuel | G06F 3/14 345/204 |
| 8,775,694 | B2 | 7/2014 | Pedersen et al. | |
| 8,935,935 | B2 * | 1/2015 | Waugh | F17D 3/00 141/360 |
| 9,175,894 | B2 * | 11/2015 | Mitchell | F25C 5/005 |
| 2014/0261879 | A1 * | 9/2014 | Baack | F25C 5/005 141/83 |

(Continued)

*Primary Examiner* — Timothy L Maust
(74) *Attorney, Agent, or Firm* — Dority & Manning, P.A.

(57) ABSTRACT

Systems and methods for controlling the operation of a dispenser system are provided. In particular, one or more sensors associated with the dispenser system may be configured to detect one or more signals indicative of a container proximate the dispenser system and/or a level of water or ice within the container. The dispenser system may include an analog-to-digital converter configured to sample the detected signals at a predetermined sample frequency. The dispenser system may further include a direct memory access controller configured to store the sampled signals in memory without having to rout the sampled signals through a central processing unit associated with dispenser system. The operation of the dispenser system can then be controlled based at least in part on the sampled signals.

20 Claims, 6 Drawing Sheets

(56) References Cited

U.S. PATENT DOCUMENTS

2014/0373561 A1* 12/2014 Alt ..... F25D 23/02
62/125
2016/0334158 A1* 11/2016 Joo ..... F25D 29/005

* cited by examiner

CONTROLLING THE OPERATION OF A DISPENSER SYSTEM

FIELD OF THE INVENTION

The present disclosure relates generally to a dispenser system and more particularly to controlling the operation of a dispenser system using a direct memory access controller to assist in signal acquisition.

BACKGROUND OF THE INVENTION

Refrigerator appliances generally include one or more cabinets defining chambers for the receipt of food items for storage. Refrigerator appliances may also include features for dispensing ice and/or water. To provide ice and/or water, a dispenser is typically positioned on a door of the appliance. The user positions a container proximate the dispenser and ice, water, or both are deposited into the container depending upon the user's selection. A paddle or other type switch can be provided whereby the user can make a selection. Typically, the water is chilled by routing through one of the refrigerated chambers.

Some dispensers may be configured to automatically fill the container with liquid or ice using a sensor arrangement configured to detect the height and/or presence of a container positioned proximate the dispenser. For instance, conventional dispenser systems may implement a horizontal sensor to detect a position of the container, and a vertical sensor to detect a top lip of the container and/or a liquid level within the container. As another example, some conventional dispenser systems may implement only a vertical sensor to detect a presence of the container, as well as the top lip and/or liquid level.

Conventional systems typically use software techniques to control the timing and/or operation of the dispenser. Such conventional techniques can be difficult to implement due at least in part timing inconsistencies caused by latency associated with the software techniques. Such timing inconsistencies can cause decreased detection accuracy. In addition, such techniques can require expensive processors due at least in part to the significant amount processor resources required. Thus, there is a need for a dispensing system that provides improved performance while requiring fewer processor resources.

BRIEF DESCRIPTION OF THE INVENTION

Aspects and advantages of the invention will be set forth in part in the following description, or may be obvious from the description, or may be learned through practice of the invention.

One example aspect of the present disclosure is directed to a dispensing system for dispensing liquid or ice. The system includes a dispenser defining a dispensing recess, the dispenser including a nozzle for dispensing liquid or ice. The system further includes one or more sensors disposed within the dispensing recess. The one or more sensors are configured to emit one or more pulses during one or more time periods and to receive one or more return signals. The system further includes an analog-to-digital converter configured to sample the one or more return signals at a predetermined sampling frequency to determine a plurality of discrete signals. The system further includes a direct memory access controller configured to store the discrete signals in one or more memory devices. The system further includes one or more control devices configured to execute computer-readable instructions stored in one or more memory devices that when executed by the one or more control devices cause the one or more control devices to perform operations. The operations include determining a return time indicative of a time period between emission of the one or more pulses and reception of the one or more return signals by the one or more sensors. The operations further include controlling an operation of the dispensing system based at least in part on the determined return time.

Another example aspect of the present disclosure is directed to a method of dispensing liquid or ice by a dispensing system associated with a refrigerator appliance. The method includes receiving, by an analog-to-digital converter, one or more return signals, wherein at least one of the one or more return signals is indicative of a container positioned proximate a dispensing system. The method further includes sampling, by the analog-to-digital converter, the one or more return signals at a predetermined sampling frequency to determine a plurality of discrete signals. The method further includes providing, by a direct memory access controller, each of the discrete signals to one or more memory devices without routing the discrete signals to a central processing unit. The method further includes providing, by the direct memory access controller, an interrupt to the central processing unit when a threshold number of samples have been provided to the one or more memory devices.

Yet another example aspect of the present disclosure is directed to a refrigerator appliance comprising a cabinet defining a chilled chamber for receipt of food articles. The refrigerator appliance further includes a door mounted to the cabinet configured for permitting selective access to the chilled chamber of the cabinet. The refrigerator appliance further includes a dispenser mounted to the door defining a dispensing recess and including a nozzle for dispensing liquid or ice. The refrigerator appliance further includes one or more sensors disposed within the dispensing recess configured to emit one or more pulses during one or more time periods and to receive one or more return signals. The refrigerator appliance further includes an analog-to-digital converter configured to sample the one or more return signals at a predetermined frequency to determine a plurality of discrete signals. The refrigerator appliance further includes a direct memory access controller configured to store the discrete signals in one or more memory devices. The refrigerator appliance further includes one or more control devices configured to execute computer-readable instructions stored in the one or more memory devices that when executed by the one or more control devices cause the one or more control devices to perform operations comprising determining a return time indicative of a time period between emission of the one or more pulses and reception of the one or more return signals by the one or more sensors, and controlling an operation of the dispensing system based at least in part on the determined return time.

Variations and modifications can be made to these example embodiments of the present disclosure.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
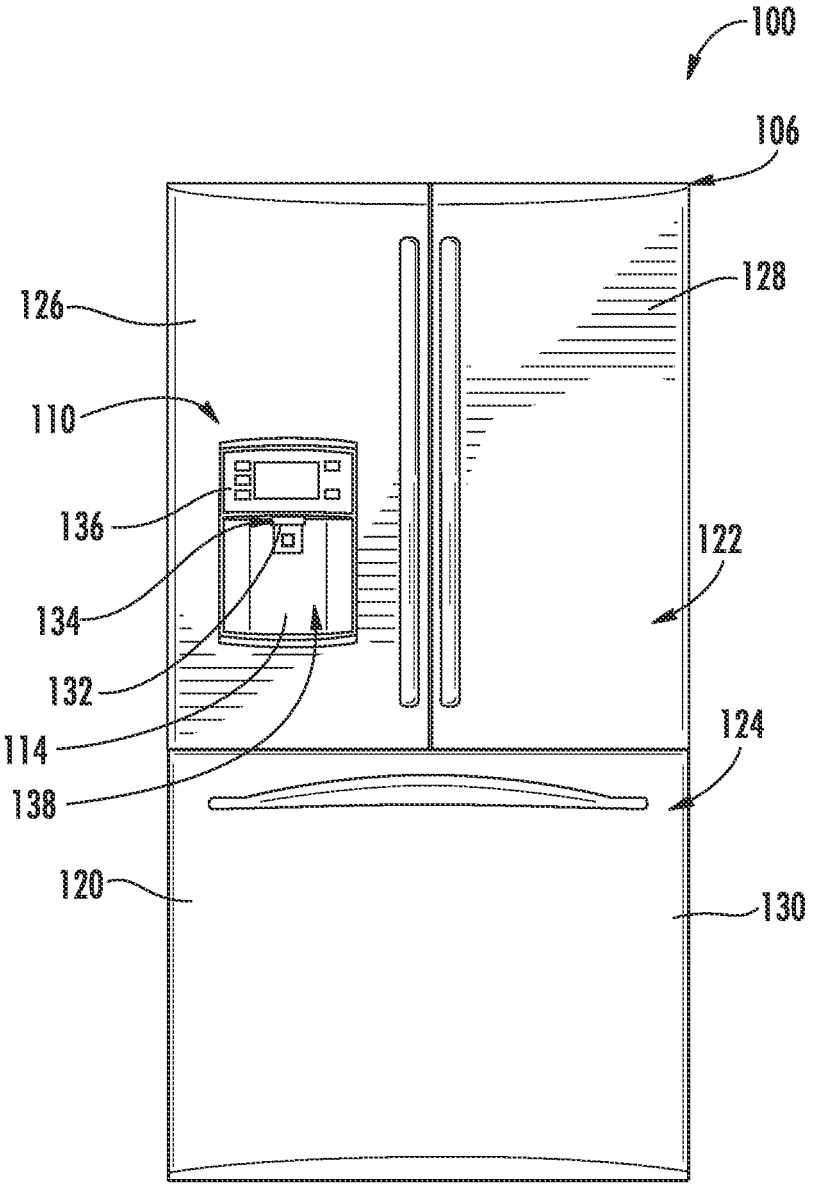
FIG. 1 depicts an example refrigerator appliance according to example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Example aspects of the present disclosure are directed to controlling a dispenser system. In particular, a dispenser system, such as for instance, a dispenser system associated with a refrigerator appliance can be configured to detect the presence of a container proximate the dispenser. For instance, the dispenser may have one or more associated sensors, such as one or more ultrasonic sensors, configured to emit a pulse train over one or more time periods and to receive one or more return signals indicative of the container. The one or more return signals can include signals emitted by the sensor(s) (e.g. the pulse train) that are reflected by the container or other surface back to the sensor(s). Such signals can be analog signals. In example embodiments, the one or more return signals can be provided to an analog-to-digital converter (ADC), which can convert the analog return signals into one or more discrete values.

The converted signals can then be stored in a memory for future processing. In example embodiments, a direct memory access (DMA) controller can be used to store the converted signals into memory without routing the signals through a primary processor (e.g. central processing unit) associated with the dispenser system. In this manner, the DMA controller may generate memory addresses and/or initiate memory read/write cycles, thereby allowing the converted signals to be read into memory independently of the primary processor.

The DMA controller can be further configured to count of a number of samples stored into memory. When the number of stored samples reaches a predetermined threshold, the DMA controller can be configured to provide one or more signals to the primary processor indicative of a completed sample sequence. Responsive to receiving such signals, the primary processor can be configured to disable the ADC and/or the DMA controller until the initiation of a subsequent sample sequence.

A height of the container and/or a distance between the ultrasonic sensor and a top lip or rim of the container can then be determined based at least in part on the stored samples. In particular, such measurements can be determined at least in part from a time period associated with a return signal (e.g. an amount of time taken for the emitted pulses to travel from the sensor(s), and back to the sensor(s) after having been reflected by one or more surfaces), and a transmission speed of the return signal (e.g. the speed of sound through air).

The dispenser system can be configured to dispense water (or other suitable liquid) or ice upon the detection of the container proximate the dispenser. In example embodiments, dispenser may be configured to dispense water or ice upon the detection of the container, and in conjunction with a user input. For instance, the dispenser may dispense water or ice only when a container is detected and when a user input is received.

A level of water or ice in the container can then be determined in accordance with example embodiments of the present disclosure. For instance, as the container fills with water or ice, the rising level of the water or ice within the container can be detected. A signal indicative of the water or ice can be provided to one or more control devices, which can determine the level of the water or ice from the signal. The level of water or ice can be determined using the same or similar techniques as relating to the determination of the top lip of the container.

When the difference between the height of the container and the level of the water or ice falls below a threshold, the dispenser can cease dispensing water or ice. In example embodiments, the threshold can be in the range of about ½ inch to about 3 inches below the top lip of the container. As used herein, the term "about," when used in reference to a numerical value, is intended to refer to within 30% of the numerical value. It will be appreciated that various other suitable thresholds may be used. In example embodiments, the level of the water or ice relative to the height of the lip of the container can be determined at least in part from the amount of time between detecting the top lip and detecting the water or ice.

Referring now to the figures, FIG. 1 depicts a front view of an example embodiment of a refrigerator appliance 100. Refrigerator appliance 100 includes a cabinet or housing 120 defining an upper fresh food chamber 122 and a lower freezer chamber 124 arranged below the fresh food chamber 122. As such, refrigerator appliance 100 is generally referred to as a bottom mount refrigerator. In the example embodiment, housing 120 also defines a mechanical compartment (not shown) for receipt of a sealed cooling system. Using the teachings disclosed herein, one of skill in the art will understand that the present invention can be used with other types of refrigerators (e.g., side-by-sides). Consequently, the description set forth herein is for illustrative purposes only and is not intended to limit the invention in any aspect.

Refrigerator doors 126, 128 are rotatably hinged to an edge of housing 120 for accessing fresh food compartment 122. A freezer door 130 is arranged below refrigerator doors 126, 128 for accessing freezer chamber 124. In the example embodiment, freezer door 130 is coupled to a freezer drawer (not shown) slidably mounted within freezer chamber 124.

Refrigerator appliance 100 includes a dispensing assembly 110 for dispensing water and ice. Dispensing assembly 110 includes a dispenser 114 positioned on an exterior portion of refrigerator appliance 100. Dispenser 114 includes a discharging outlet 134 for accessing ice and water. It will be appreciated that dispensing assembly 110 can be positioned on various suitable portions of refrigerator appliance 100 without deviating from the spirit of the present disclosure.

A user interface panel 136 is provided for controlling the mode of operation. For example, user interface panel 136 includes a water dispensing button (not labeled) and an ice-dispensing button (not labeled) for selecting a desired mode of operation such as crushed, non-crushed ice, or water, etc.

Discharging outlet 134 is an external part of dispenser 114, and is mounted in a dispensing recess or recessed portion 138 defined in an outside surface of refrigerator door 126. Recessed portion 138 is positioned at a predetermined elevation convenient for a user to access ice or water and enabling the user to access ice of water without the need to bend-over and without the need to access freezer chamber 124. In the example embodiment, recessed portion 138 is positioned at a level that approximates the chest level of a user.

Operation of the refrigerator appliance 100 is regulated by a controller (not shown) that is operatively coupled to user interface panel 136. Panel 136 provides selections for user manipulation of the operation of refrigerator appliance 100 such as e.g., selections between whole or crushed ice, chilled water, and/or other options. In response to user manipulation of the user interface panel 136, the controller operates various components of the refrigerator appliance 100. The controller may be positioned in a variety of locations throughout refrigerator appliance 100. In the illustrated embodiment shown in FIG. 1, controller is located within beneath the user interface panel 136 on door 126. In such an embodiment, input/output ("I/O") signals may be routed between controller and various operational components of refrigerator appliance 100. In one exemplary embodiment, the user interface panel 136 may represent a general purpose I/O ("GPIO") device or functional block. In another example embodiment, the user interface 136 may include input components, such as one or more of a variety of electrical, mechanical or electro-mechanical input devices including rotary dials, push buttons, and touch pads. The user interface 136 may be in communication with the controller via one or more signal lines or shared communication busses.

Figure 2:
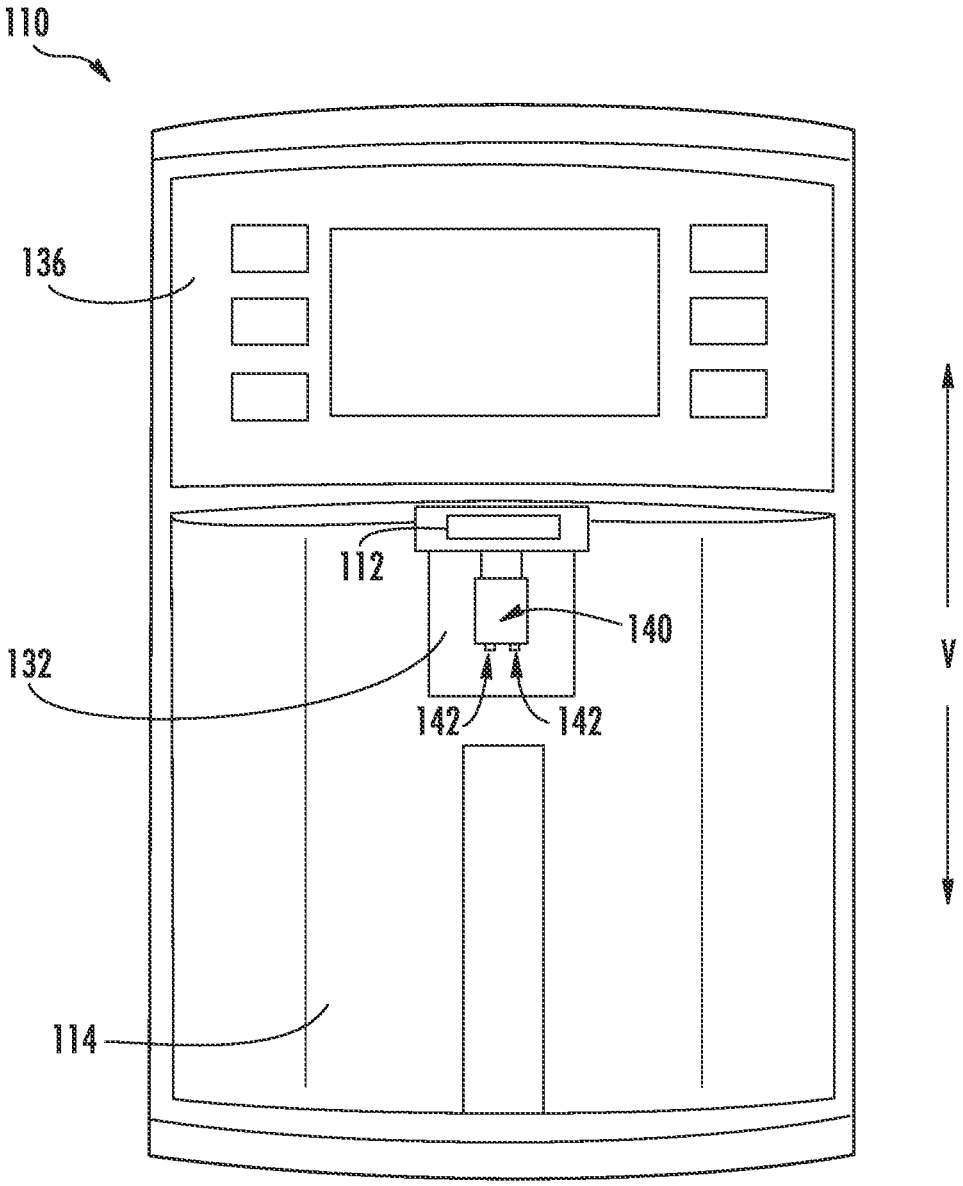
FIG. 2 depicts an example dispensing assembly according to example embodiments of the present disclosure.

FIG. 2 provides a close-up front view of the dispenser 114 of dispensing assembly 110. An example nozzle 140 of the present invention is positioned adjacent to an activation member 132. Nozzle 140 includes a plurality of fluid outlets 142 through which water may flow into a container placed into the recess 138 of dispensing assembly 110 by a user of appliance 100. Dispensing assembly 110 can further include one or more sensors, such as sensor 112. Sensor 112 can be configured to detect a presence of a container positioned within dispensing assembly 110, and to detect the top lip of the container. Although only one sensor is depicted in FIG. 2, it will be appreciated that any suitable number of sensors may be used without deviating from the scope of the present disclosure.

Sensor 112 can be positioned parallel to the water stream dispensed by dispenser 114. In particular, sensor 112 can be positioned within an upper portion of dispenser 114 such that one or more signals generated by sensor 112 are transmitted parallel to the water stream. In this manner, sensor 112 may be positioned vertically with respect to a container placed in dispenser 114. It will be appreciated that sensor 112 can be positioned in various other suitable locations without deviating from the scope of the present disclosure.

In example embodiments, sensor 112 may be an ultrasonic transducer configured to periodically transmit and receive high frequency sound waves, and to convert the received sound waves into electrical data. In particular, sensor 112 may be configured to generate and transmit sound waves, and to receive one or more echoed sound waves (e.g. return signals). It will be appreciated that various other sensors and/or sensor configurations may be used, such as for instance, a sensor configuration including a separate and distinct transmitter and receiver.

Figure 3:
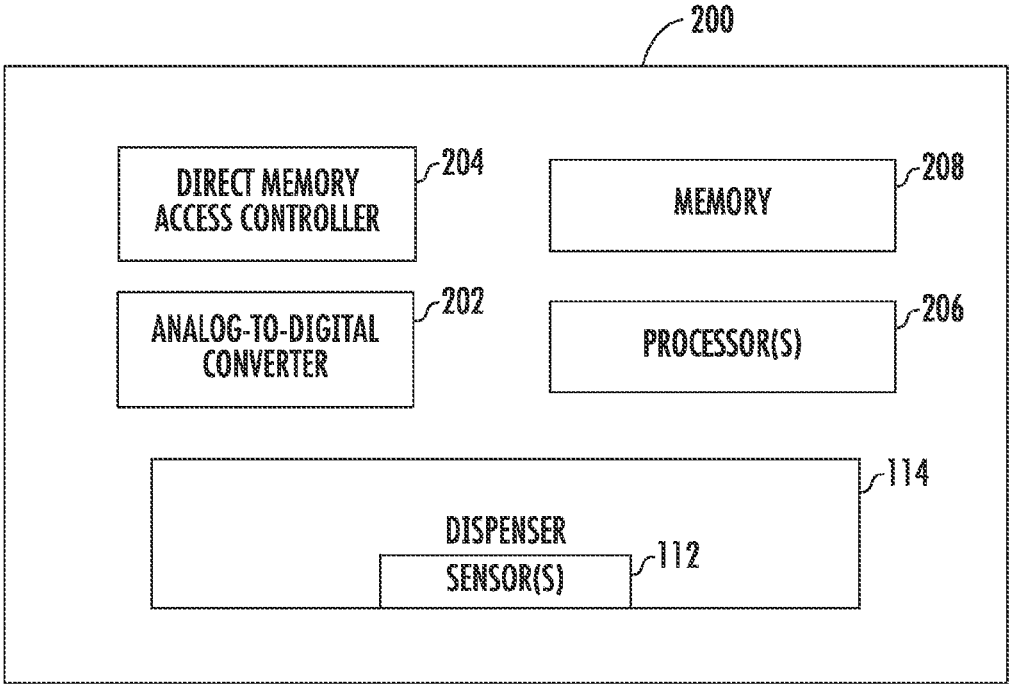
FIG. 3 depicts an example system for controlling the operation of a dispenser system according to example embodiments of the present disclosure.

FIG. 3 depicts a block diagram of an example system 200 for controlling a dispenser according to example embodiments of the present disclosure. As depicted, system 200 includes a dispenser 114 including one or more sensors 112. System 200 further includes an analog-to-digital converter (ADC) 202, and a direct memory access (DMA) controller 204 in communicative operation with dispenser 114, one or more processors, such as processor 206 and memory 208. ADC 202 can include various suitable types of converters, such as a successive-approximation ADC, a direct-conversion ADC, a ramp compare ADC, an integrating ADC, a delta-encoded ADC, a pipeline ADC, a sigma-delta ADC, a time-interleaved ADC, etc.

Processor(s) 206 and/or memory 208 can be configured to perform a variety of computer-implemented functions and/or instructions (e.g. performing the methods, steps, calculations and the like and storing relevant data as disclosed herein). The instructions when executed by processor(s) 206 can cause the processor(s) to perform operations, including providing control commands to various aspects of refrigerator appliance 100.

As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. The processor is also configured to compute advanced control algorithms and communicate to a variety of Ethernet or serial-based protocols (Modbus, OPC, CAN, etc.). Additionally, the memory device(s) may generally comprise memory element(s) including, but not limited to, computer readable medium (e.g. random access memory (RAM)), computer readable non-volatile medium (e.g. read-only memory, or a flash memory), a floppy disk, a compact disc-read only memory (CD-ROM), a magneto-optical disk (MOD), a digital versatile disc (DVD) and/or other suitable memory elements. Such memory device(s) may generally be configured to store suitable computer-readable instructions that, when implemented by the processor(s), configure processor(s) 206 to perform the various functions as described herein. The memory may be a separate component from the processor or may be included onboard within the processor.

As indicated above, sensor 112 can be configured to emit one or more pulses over one or more time periods. In example embodiments, the sensor can be controlled in accordance with one or more timers used to control the timing of the pule emissions. The one or more timers can be dependent on one or more clocks associated with system 200. For instance, a first timer can trigger a pulse emission, and a second timer can be used to stop the emission. In example embodiments, the second timer can further trigger a sampling sequence associated with ADC 202. ADC 202 can be configured to receive one or more analog return signals from dispenser 114 and/or sensor(s) 112. Upon the initiation of a sampling sequence, ADC 202 can be further configured to sample the return signals at a particular frequency to determine a plurality of discrete values associated with the return signals. ADC 202 can be configured to sample the return signals at various suitable frequencies. Such discrete values can be used to determine a presence of a container proximate dispenser 114 and/or a level of water or ice relative to a top lip of the container.

In example embodiments, ADC 202 can operate in a continuous sample mode, wherein multiple samples are taken in succession. In particular, upon initiation of a sample sequence, ADC 202 can continuously sample the return signal at a specified frequency for a given time period. The sample frequency and time period can correspond to a desired sample resolution of the return signals. For instance, in example embodiments, the sample frequency can be chosen to be between about 5 microseconds and about 10 microseconds and the given time period can be between about 1.5 milliseconds and about 2 milliseconds.

DMA controller 204 can be configured to facilitate a transfer of the determined discrete values to memory 208. In particular, DMA controller 204 can react to the completion of each individual sample performed by ADC 202. For instance, DMA controller 204 can read the results of the conversion (e.g. the sampled discrete value) and store the read value in memory 208. In particular, as indicated above, DMA controller 204 can facilitate the transfer of data from ADC 202 to memory 208 using minimal communication with processor 206. In particular, upon the initiation of a sample sequence, DMA controller 204 can provide a request for data bus control from processor 206. Upon granting of the request by processor 206, DMA controller 204 can read one or more samples from ADC 202, and write the values directly to memory 208 using, for instance, a system bus.

DMA controller 204 can further be configured to compare a number of stored values to a predetermined threshold. The threshold can correspond to a total number of samples taken during the given time period when sampling at the specified sample frequency. When the number of samples reaches the threshold, DMA controller 208 can be configured to provide one or more signals indicative of the completion of the sample sequence to processor 206. For instance, the one or more signals can be an interrupt sent by DMA controller 204 to processor 206. Upon receiving the interrupt, processor 206 can disable ADC 202 and/or DMA controller 204. In this manner, a predetermined number of samples can be taken at one or more predetermined intervals. The samples can be used by processor 206 to determine a distance from sensor 112 to one or more surfaces (e.g. a container, a level of water or ice within the container, and/or a surface of dispenser 114). As described above, processor 206 can then be configured to control the operation of dispenser 114 based at least in part on at least one of the determined distances.

Figure 4:
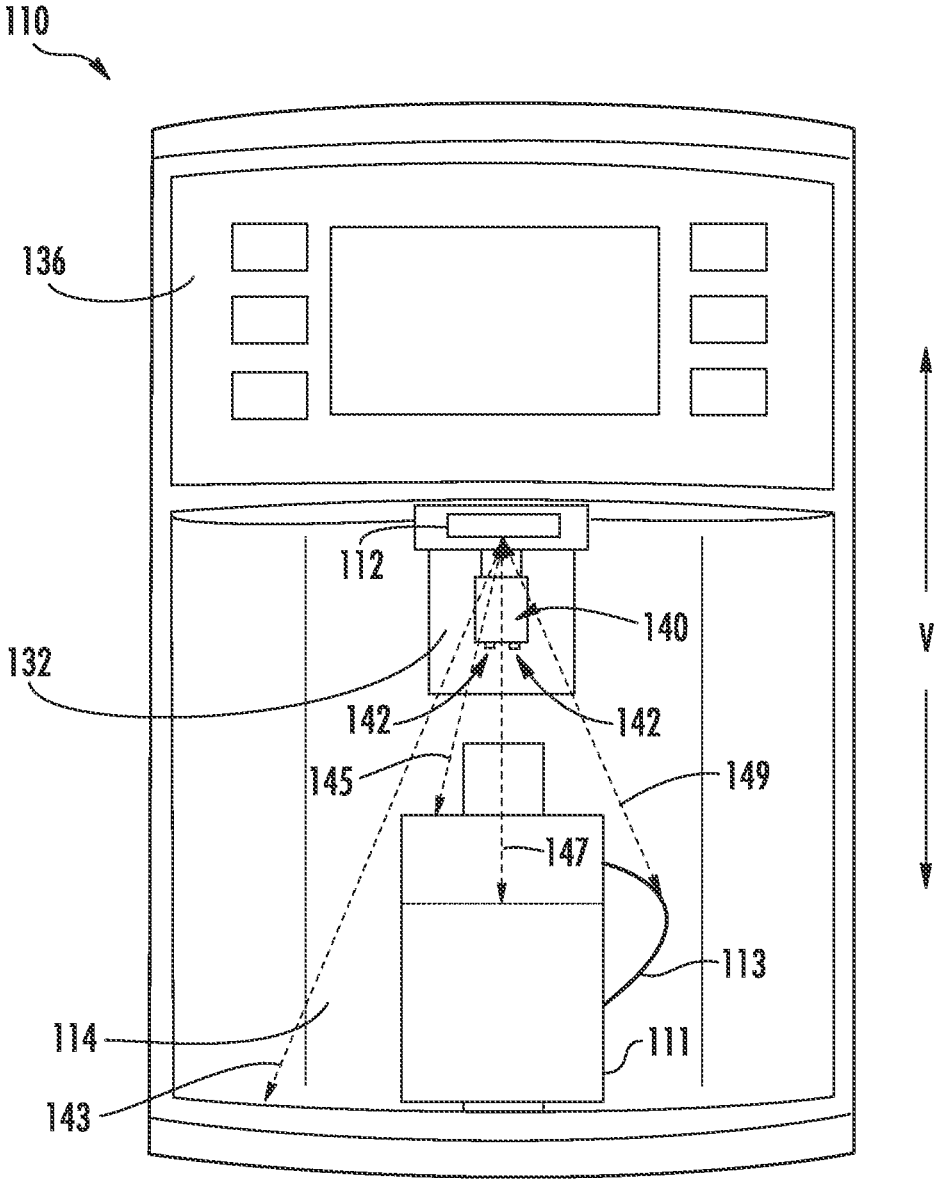
FIG. 4 depicts an example dispensing assembly having a sensor for detecting the presence of a container and a level of contents within the container according to example embodiments of the present disclosure.

FIG. 4 provides a close-up front view of the dispenser 114 of dispensing assembly 110. In example embodiments, sensor 112 can be configured to detect a presence of a container 111 positioned proximate dispenser 114. For instance, sensor 112 can transmit one or more signals (e.g. sound waves), and receive one or more signals (e.g. reflected sound waves) indicative of container 111. In particular, the presence of a container can be detected at least in part by a comparison of a received signal with a baseline signal. The baseline signal can be a signal received by sensor 112 that is not reflected by a container. For instance, the baseline signal can be a signal transmitted by sensor 112 that is reflected, for instance, by a bottom surface of dispenser 114. Such signal can have an associated time interval corresponding to a particular known time interval (or range of time) for a signal transmitted by sensor 112 to return to sensor 112 in the absence of a container. When container 111 is positioned proximate dispenser 114, a different signal can be received corresponding at least in part to the signal reflected by container 111. Such signal can have a different corresponding time interval (or range of time), which can be indicative of the presence of container 111.

In example embodiments, the detection of the presence of container 111 can trigger a dispense enable, such that water or ice can be allowed to dispense from dispenser 114. In alternative embodiments, the dispense enable can be triggered responsive to a user input indicative of a request for water or ice. For instance, a user can interact with use interface panel 136 of FIG. 1 to request water or ice, and responsive to this interaction, the dispense enable can be triggered. When the dispense enable is triggered, water or ice can be dispensed from dispenser 114 responsive to, for instance, a user interaction with user interface panel 136 indicative of a request for water or ice. In this manner, the presence of a container must be detected before dispenser 114 will dispense water or ice. For instance, if a user provides an input to user interface panel 136 indicative of a request to dispense water, water will not be dispensed unless a container is detected proximate dispenser 114 in conjunction with the user input.

Sensor 112 can be further configured to detect a level of water or ice in container 111 relative to a top lip of container 111. In example embodiments, sensor 112 can be configured to detect the level of the water or ice once the presence of a container has been detected. For instance, when a container is positioned proximate dispenser 114, various signals can be received by sensor 112 indicative of the various surfaces by which the signals are reflected. For instance, a signal can be received indicative of a bottom surface of dispenser 114 (e.g. signal 143). Such signal can correspond to the baseline signal described above. Further, a signal can be received indicative of the top lip of container 111 (e.g. signal 145), and a signal can be received indicative of the water or ice level within container 111 (e.g. signal 147). One or more signals may further be received indicative of the various geometries of container 111 (e.g. signal 149). For instance, container 111 includes a handle 113 extending horizontally from container 111. As shown, signal 149 is indicative of handle 113. As another example, if a container has a geometry wherein a middle portion of the container has a larger radius than the top lip of the container, a signal may be received indicative of the middle portion, and a different signal may be received indicative of the top lip.

In example embodiments, the top lip can be identified based at least in part on the first received signal by sensor 112, such that the first received signal corresponds to the surface closest to the sensor (e.g. the top lip). In this manner, the signal indicative of the top lip of container 111 can be distinguished from a signal indicative of, for instance, a middle portion of container 111 (e.g. handle 113), or from a signal indicative of water or ice in container 111. As described above, such signals can have an associated time intervals corresponding to the time it takes for the signal to travel from sensor 112, reflect off of a surface, and be received by sensor 112. The signal indicative of the top lip can have the shortest associated time interval.

Once the top lip is identified, a water or ice level within container 111 can also be identified. In particular, as dispenser 114 dispenses water or ice, the water or ice level within container 111 will rise. As the level rises, the time interval corresponding to the signal that reflects off of the water or ice will decrease. The signal indicative of the water or ice level may be identified due at least in part to the change in the level of the water or ice. In this manner, the signal indicative of the water level can be distinguished, for instance, from a signal indicative of a protruding middle portion of container 111. For instance, a signal indicative of the level of water in container 111 (e.g. signal 147), and a signal indicative of a middle portion of container 111 (e.g. signal 149) can each have time intervals that are less than the time interval associated with signal 143 (e.g. the baseline signal) but greater than the time interval associated with signal 145. In example embodiments, the signal indicative of the level of water can be distinguished from the signal indicative of the middle portion due to the changing characteristics of the signal indicative of the water level.

Once the signals indicative of the top lip and the water or ice level have been identified, the water or ice level can be measured relative to the top lip. For instance, as the water or ice level rises, the distance between the water or ice level and the top lip will decrease. When the distance between the top lip and the water or ice level falls below a threshold distance, dispenser 114 can be configured to cease dispensing water or ice. The threshold distance can be, for instance, between about 3 centimeters and 15 centimeters. In example embodiments, the distance between the top lip and the water or ice level can be determined based on the difference between the time intervals of the respective signals. Dispenser 114 can be configured to cease dispensing water or ice when the difference between the time intervals corresponds to the threshold distance.

In example embodiments, a signal indicative of ice in container 111 can be distinguished from a signal indicative of water in container 111. For instance, a container may first contain an amount of ice when a user requests for water to be dispensed, such that the rising water level may not initially be detected by sensor 112 due at least in part to the presence of the ice. In such embodiments, when ice can be detected but not water, dispenser 114 may be configured to blindly dispense water for an initial time period although the water level cannot initially be detected. For instance, the initial time period may be a predetermined time period, or may be determined at least in part from the determined height of container 111.

As indicated above, it will be appreciated that various sensing techniques can be used without deviating from the scope of the present disclosure. For instance, although only one sensor 112 was depicted in FIG. 4 to detect a presence of container 111, a top lip of container 111 and a level of liquid or ice within container 111, various other suitable sensor arrangements and/or sensing techniques can be used. In particular, multiple sensors may be used to detect various signals associated with container 111 in multiple manners.

Figure 5:
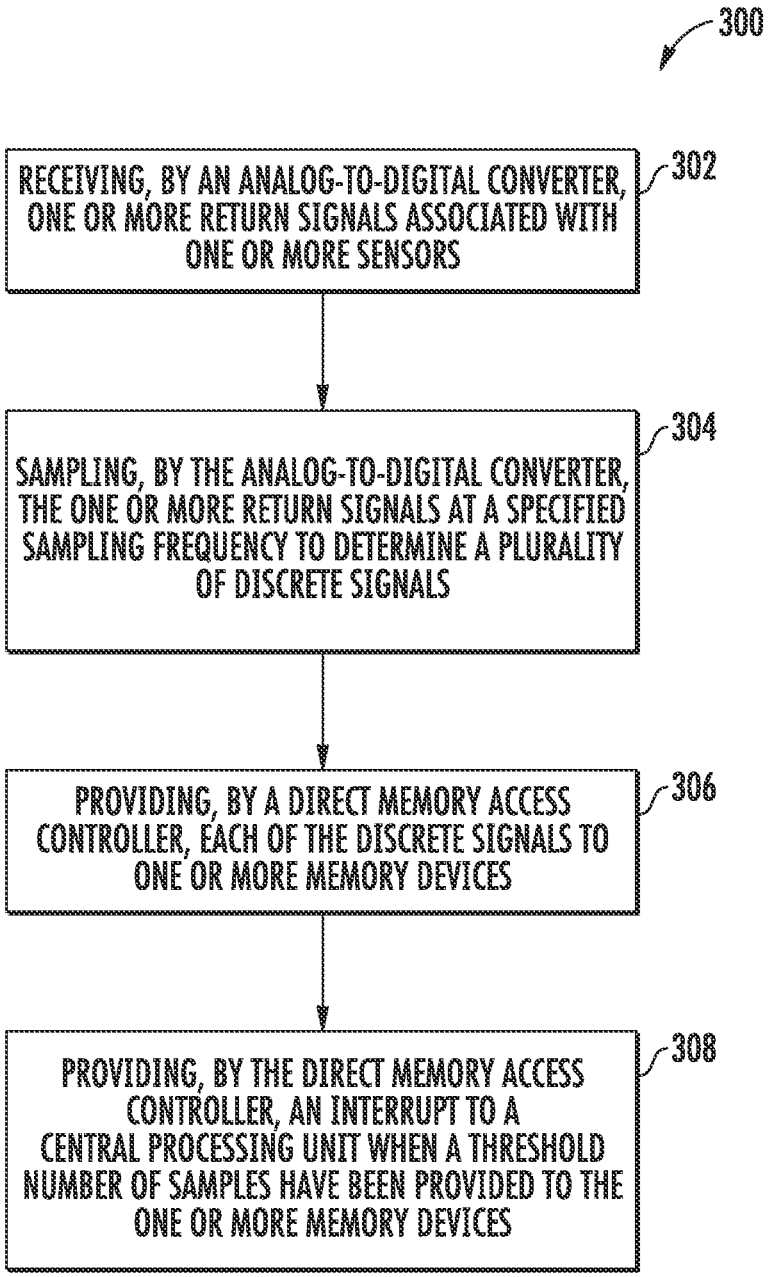
FIG. 5 depicts a flow diagram of an example method of controlling the operation of a dispensing system according to example embodiments of the present disclosure.

FIG. 5 depicts a flow diagram of an example method (300) of controlling the operation of a dispenser according to example embodiments of the present disclosure. The method (300) can be implemented by one or more computing devices, such as one or more of the computing devices in FIG. 3. In addition, FIG. 5 depicts steps performed in a particular order for purposes of illustration and discussion, those of ordinary skill in the art, using the disclosures provided herein, will understand that various steps of any of the methods discussed herein can be adapted, modified, rearranged, omitted, or expanded in various ways without deviating from the scope of the present disclosure.

At (302), method (300) can include receiving, by an analog-to-digital converter (ADC) one or more return signals associated with one or more sensors. As indicated above, the one or more sensors can be configured to emit one or more pulses in accordance with at least one timer, and to receive one or more return signals. The return signals can include echoes of at least one of the pulses emitted by the sensors. In particular, the return signals can be analog signals. The echoes can correspond to an increase in amplitude of the analog signals. The echoes can be indicative of one or more surfaces off of which the echoes were reflected. The one or more surfaces can correspond to a container proximate a dispenser system, water or ice within the container, and/or various surfaces of the dispenser system. The return signals can be provided to the ADC, for instance, upon the initiation of a sampling sequence. The initiation of the sampling sequence can be triggered, for instance, upon the emission of the pulse(s). As another example, the sampling sequence can be triggered upon completion of the emission.

At (304), method (300) can include sampling, by the ADC, the return signals. Sampling the return signals can include converting the analog, continuous return signals to a plurality of discrete signals. In this manner, the ADC can measure the amplitude of the return signals. The ADC can be configured to sample the return signals at a specified frequency. The sample frequency can correspond to a desired resolution associated with the discrete signals. As described above, the ADC can be configured to operate in a continuous sampling mode, wherein the ADC immediately begins taking another sample upon the completion of a previous sample. In example embodiments, the ADC can use a successive approximation technique to enforce the sample frequency.

At (306), method (300) can include providing, by a direct memory access (DMA) controller, each sampled signal to one or more memory devices. The DMA controller can be configured to provide the signals directly to memory via a system bus, such that the signals are not first routed to a central processing unit. In this manner, the central processing unit can initially grant control of the system bus to the DMA controller, for instance, responsive to a request from the DMA controller. Upon receiving system bus control, the DMA controller can read data from the ADC (e.g. the discrete signals) and write the data to memory. For instance, the DMA controller can be configured to store each sampled value into memory upon the completion of the sample. In particular, upon the completion of an individual sample, the ADC can send a signal indicative of the completed sample to the DMA controller. Responsive to receiving the signal from the ADC, the DMA controller can store the sample into memory.

At (308), method (300) can include providing, by the DMA controller, an interrupt to a central processing unit when the number of signals that are stored in memory reaches a threshold value. The threshold value can correspond to an amount of samples that can be taken during a predetermined time period at a specified frequency. As indicated above, the sampling frequency can be selected to facilitate a desired resolution of the discrete signals. The predetermined time period can correspond to a distance for which measurement is desired. For instance, the distance can correspond to an approximate distance of a bottom portion of the dispenser system from the sensors. In this manner, the predetermined time period can approximately correspond to an amount of time needed for the one or more signals to travel from the sensors to the bottom portion of the dispenser, and back to the sensors.

When the number of stored signals reaches the threshold value, the DMA controller can provide the interrupt to the central processing unit. The interrupt can be indicative of the end of an individual sample sequence. Responsive to receiving the interrupt, the central processing unit can disable the DMA controller and/or the ADC.

Figure 6:
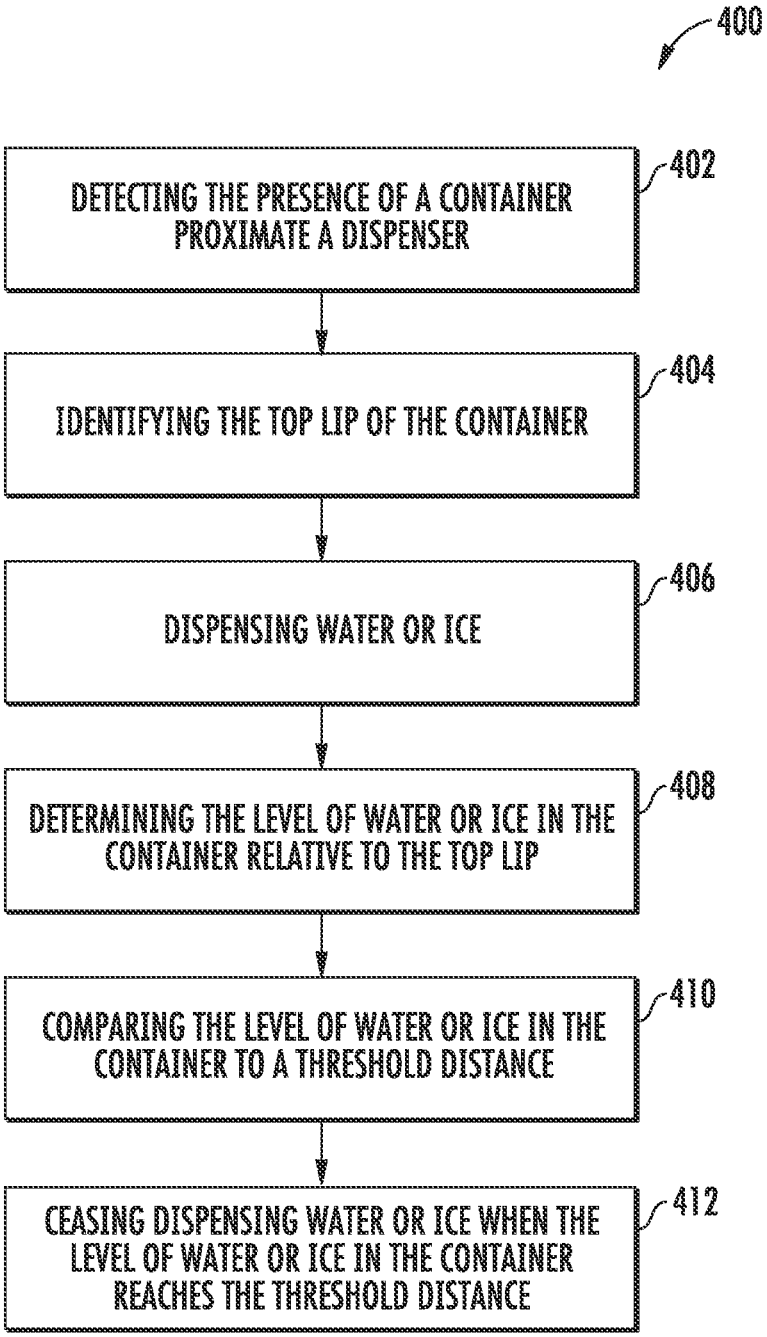
FIG. 6 depicts a flow diagram of an example method of controlling the operation of a dispensing system according to example embodiments of the present disclosure.

The central processing unit can be further configured to control the operation of the dispenser system based at least in part on the signals stored in memory by the DMA controller. For instance, FIG. 6 depicts a flow diagram of an example method (400) of controlling the operation of a dispenser system according to example embodiments of the present disclosure. At (402), method (400) can include detecting the presence of a container proximate a dispenser. As indicated above, the presence of the container can be detected at least in part from comparing the digitized signals from the sensor to a baseline signal.

At (404), method (400) can include identifying a signal indicative of a top lip of the container. The top lip of the container can correspond to the highest point of the container. For instance, the top lip can be a rim of the container. The top lip of the container can be identified at least in part from the one or more discrete signals. In particular, as described above, the top lip can correspond to signal having the shortest associated time interval.

At (406), method (400) can include determining the level of water or ice within the container. The level of water or ice can be determined at least in part from the one or more discrete signals. In example embodiments, water or ice in the container can be identified based at least in part on a change in signals received from the sensor. In particular, as the water or ice level rises (e.g. as water or ice is being dispensed into the container), the time interval associated with the sound waves reflected by the water or ice will shorten. The water or ice level can be determined based on the changing time interval of such signals.

In example embodiments, the container may have a geometry wherein one or more lower portions of the container extend outwardly beyond the top lip. For instance, the container may have a handle, such as depicted in FIG. 3. In such embodiments, the sensor may receive sound waves (e.g. return signals) reflected by the top lip and sound waves reflected from the lower portion. Signals received from the sensor indicative of the top lip of the container can be distinguished from signals indicative of the lower portion based at least in part on the time intervals associated with the signals. Further, signals indicative of the water or ice level may be distinguished from signals indicative of the lower portion. In this manner, water or ice in the container may not be confused with the lower portion of the container.

At (408), method (400) can include comparing the level of water or ice within the container to a threshold distance. The threshold distance can correspond to a desired amount of water or ice in the container, such that the container does not overflow. In example embodiments, the threshold distance can be a distance measured relative to the bottom of the container (and/or the bottom surface of the dispensing assembly on which the container sits). For instance, the threshold distance can be a distance of six inches from the bottom of the container. In such embodiments, the threshold distance may be determined based at least in part on a determined height of the container. In further example embodiments, the threshold distance can be a distance measured relative to the top lip of the container. For instance, the threshold distance can be a distance of one inch from the top lip.

At (410), method (400) can include ceasing dispensing water or ice when the level of water or ice in the container reaches the threshold distance. In this manner, once the water or ice reaches an appropriate level, no more water or ice will be dispensed into the container.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dispensing system for dispensing liquid or ice, the system comprising:

a dispenser defining a dispensing recess, the dispenser comprising a nozzle for dispensing liquid or ice;

one or more sensors disposed within the dispensing recess, the one or more sensors configured to emit one or more pulses during one or more time periods and to receive one or more return signals;

an analog-to-digital converter configured to sample the one or more return signals at a predetermined sampling frequency to determine a plurality of discrete signals;

a direct memory access controller configured to store the discrete signals in one or more memory devices via a system bus without routing the discrete signals to the one or more control devices; and one or more control devices configured to execute computer-readable instructions stored in one or more memory devices that when executed by the one or more control devices cause the one or more control devices to perform operations, the operations comprising determining a return time indicative of a time period between emission of the one or more pulses and reception of the one or more return signals by the one or more sensors, and controlling an operation of the dispensing system based at least in part on the determined return time.

2. The dispensing system of claim 1, wherein at least one of the plurality of discrete signals is indicative of a container positioned proximate the dispensing system.

3. The dispensing system of claim 2, the operations further comprising detecting the presence of the container proximate the dispensing system based at least in part on the plurality of discrete signals.

4. The dispensing system of claim 1, the operations further comprising receiving an input from a user indicative of a request to dispense liquid or ice, and, responsive to receiving the input from the user, controlling the operation of the dispensing system to dispense liquid or ice.

5. The dispensing system of claim 4, the operations further comprising detecting a top portion of the container and a level of liquid or ice in the container relative to the top lip based at least in part on the plurality of discrete signals.

6. The dispensing system of claim 5, the operations further comprising controlling the operation of the dispensing system to cease dispensing liquid or ice when the level of liquid or ice in the container reaches a threshold point relative to the top portion of the container.

7. The dispensing system of claim 6, wherein a level of ice is detected in the container relative to the top lip of the container based at least in part on the plurality of discrete signals, the operations further comprising:

receiving an input from a user indicative of a request to dispense liquid, and, responsive to receiving the input from the user, controlling the operation of the dispensing system to dispense liquid; and dispensing liquid for a predetermined period of time without regard to the plurality of discrete signals.

8. The dispensing system of claim 6, wherein a level of ice is detected in the container relative to the top lip of the container based at least in part on the plurality of discrete signals, the operations further comprising:

determining the height of the top lip of the container based at least in part on the plurality of discrete signals;

receiving an input from a user indicative of a request to dispense liquid, and, responsive to receiving the input from the user, controlling the operation of the dispensing system to dispense liquid; and dispensing liquid for a period of time based at least in part on the height of the top lip of the container.

9. The dispensing system of claim 1, wherein the predetermined sampling frequency corresponds a sampling period of between about 5 microseconds and about 10 microseconds.

10. The dispensing system of claim 1, wherein the direct memory access controller is further configured to provide an interrupt to the one or more control devices when the number of discrete signals stored in the one or more memory devices reaches a sample sequence threshold.

11. The dispensing system of claim 10, wherein the sample sequence threshold corresponds to a number of samples that can be taken during a predetermined time period at the predetermined sampling frequency.

12. The dispensing system of claim 11, wherein the predetermined time period is between about 1 millisecond and about 2 milliseconds.

13. The dispensing system of claim 1, wherein the operation of the analog-to-digital converter and the direct memory access controller are controlled at least in part in accordance with one or more timers associated with the dispensing system.

14. The dispensing system of claim 1, wherein at least one of the one or more sensors is an ultrasonic transducer configured to periodically transmit one or more sound waves, and receive one or more reflected sound waves.

15. A method of dispensing liquid or ice by a dispensing system associated with a refrigerator appliance, the method comprising:

receiving, by an analog-to-digital converter, one or more return signals, wherein at least one of the one or more return signals is indicative of a container positioned proximate a dispensing system;

sampling, by the analog-to-digital converter, the one or more return signals at a predetermined sampling frequency to determine a plurality of discrete signals;

granting, by a central processing unit, control of a system bus to a direct memory access controller;

providing, by the direct memory access controller, each of the discrete signals to one or more memory devices via the system bus without routing the discrete signals to the central processing unit; and providing, by the direct memory access controller, an interrupt to the central processing unit when a threshold number of samples have been provided to the one or more memory devices.

16. The method of claim 15, further comprising:

detecting, by the central processing unit, a presence of the container proximate the dispensing system based at least in part on the plurality of discrete signals;

receiving, by the central processing unit, an input from a user indicative of a request to dispense liquid or ice; and controlling, by the central processing unit, an operation of the dispensing system to dispense liquid or ice.

17. The method of claim 16, further comprising:

identifying, by the central processing unit, a top portion of the container and a level of liquid or ice within the container relative to the top portion based at least in part on the plurality of discrete signals; and controlling the operation of the dispensing system to cease dispensing liquid or ice when the level of liquid or ice within the container reaches a threshold point relative to the top portion of the container.

18. The method of claim 15, further comprising providing, by the direct memory access controller, an interrupt to the central processing unit when a number of samples stored in the one or more memory devices reaches a sample sequence threshold, the sample sequence threshold corresponding to a number of samples that can be taken during a predetermined time period at the predetermined sample frequency.

19. The method of claim 18, further comprising, disabling, by the central processing unit, at least one of the analog-to-digital converter or the direct memory access controller based at least in part on the interrupt from the direct memory access controller.

20. A refrigerator appliance, comprising:

a cabinet defining a chilled chamber for receipt of food articles;

a door mounted to the cabinet, the door configured for permitting selective access to the chilled chamber of the cabinet;

a dispenser mounted to the door, the dispenser defining a dispensing recess and including a nozzle for dispensing liquid or ice;

one or more sensors disposed within the dispensing recess, the one or more sensors configured to emit one or more pulses during one or more time periods and to receive one or more return signals;

an analog-to-digital converter configured to sample the one or more return signals at a predetermined sampling frequency to determine a plurality of discrete signals;

a direct memory access controller configured to store the discrete signals in one or more memory devices via a system bus without routing the discrete signals to the one or more control devices; and one or more control devices configured to execute computer-readable instructions stored in the one or more memory devices that when executed by the one or more control devices cause the one or more control devices to perform operations, the operations comprising determining a return time indicative of a time period between emission of the one or more pulses and reception of the one or more return signals by the one or more sensors, and controlling an operation of the dispensing system based at least in part on the determined return time.

* * * * *